United States Patent [19]

Blake et al.

[11] 4,191,313

[45] Mar. 4, 1980

[54] TRIGGER OPERATED DISPENSER WITH MEANS FOR OBTAINING CONTINUOUS OR INTERMITTENT DISCHARGE

[75] Inventors: William S. Blake, Miami Lakes; Roy Hammett, Miami, both of Fla.

[73] Assignee: James D. Pauls and J. Claybrook Lewis and Associates, Limited, Miami, Fla.

[21] Appl. No.: 927,566

[22] Filed: Jul. 24, 1978

[51] Int. Cl.[2] ..... B05B 11/02

[52] U.S. Cl. ..... 222/335; 222/341; 222/383; 239/333; 417/544

[58] Field of Search ..... 222/207, 335, 310, 340, 222/341, 383, 385, 407, 406, 258, 262, 263, 253, 261; 239/333, 396, 397; 417/541, 544, 566

[56] References Cited

U.S. PATENT DOCUMENTS

| | | | |
|---|---|---|---|
| 3,865,313 | 2/1975 | Kondo | 239/333 |
| 3,921,861 | 11/1975 | Kondo | 239/333 X |
| 4,079,865 | 3/1978 | Kutik | 222/340 X |
| 4,109,832 | 8/1978 | Kutik et al. | 222/340 X |
| 4,146,155 | 3/1979 | Kutik et al. | 222/385 X |

*Primary Examiner*—David A. Scherbel
*Attorney, Agent, or Firm*—Dennis H. Lambert

[57] ABSTRACT

A trigger operated dispenser includes a plurality of chambers with movable members therein, and operable to draw material from a container, pressurize it, accumulate a quantity of material under pressure, and discharge the material to a point of use. An adjustable member communicates with the chambers for selectively obtaining either continuous or intermittent discharge of the material.

17 Claims, 12 Drawing Figures

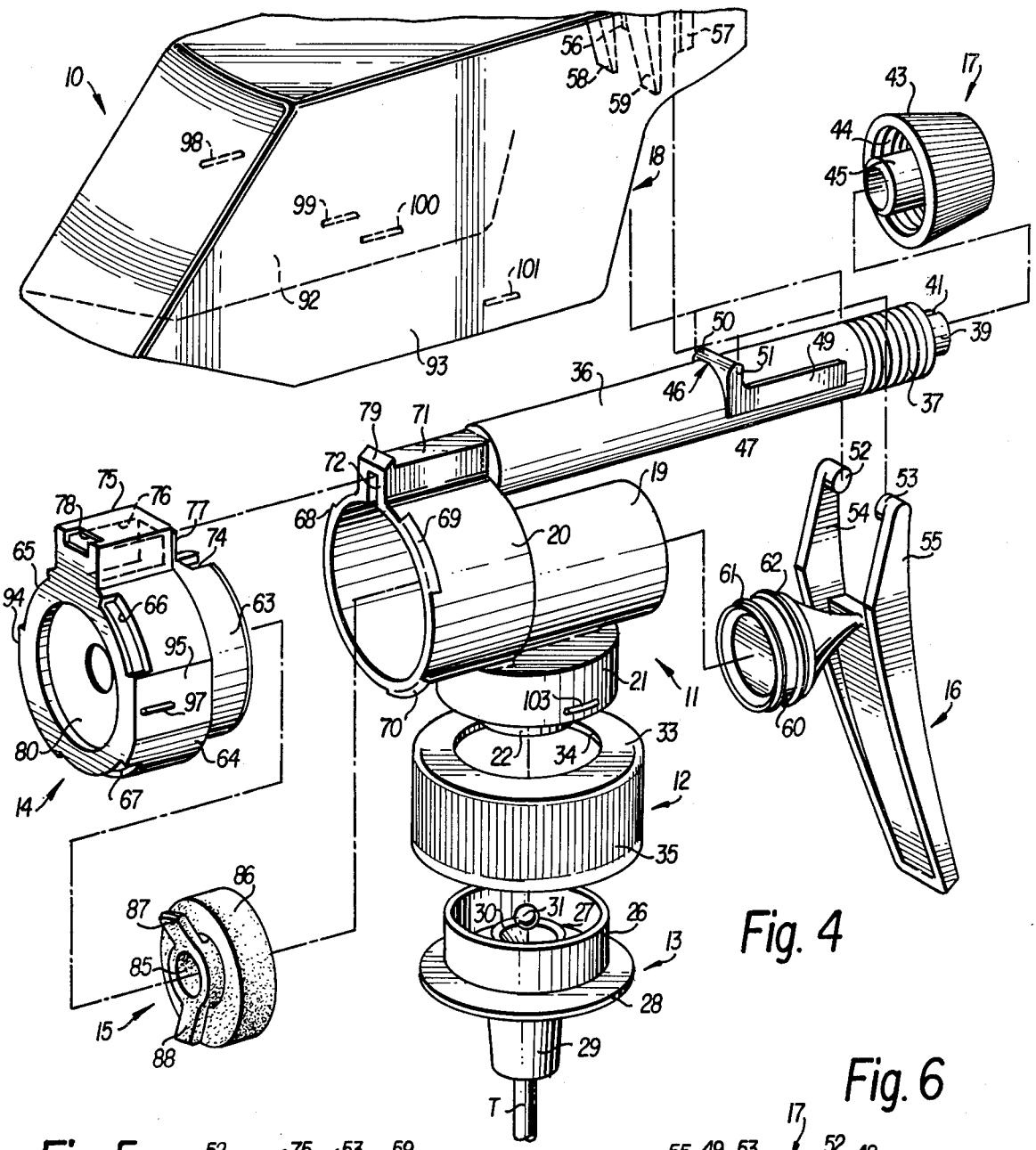
Fig. 4
Fig. 5
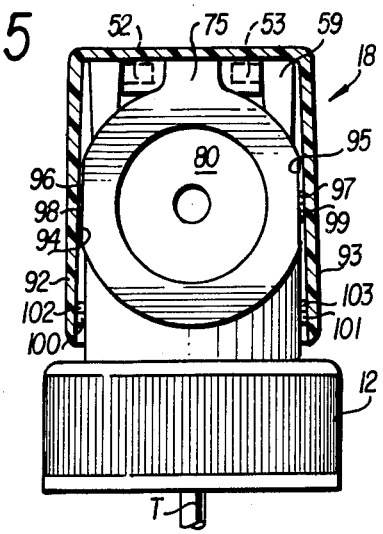
Fig. 6
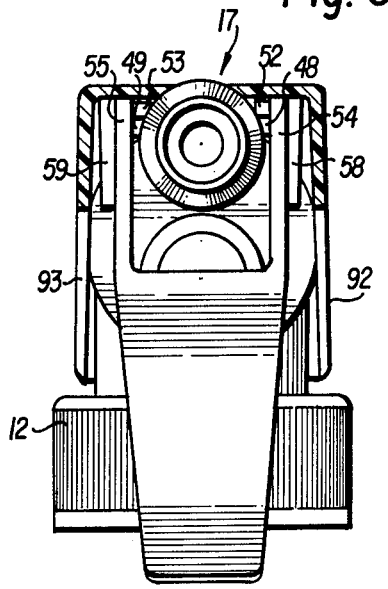

TRIGGER OPERATED DISPENSER WITH MEANS FOR OBTAINING CONTINUOUS OR INTERMITTENT DISCHARGE

FIELD OF THE INVENTION

This invention relates generally to dispensers, and more particularly, to aerosol dispensers of the type which rely upon mechanical means to obtain pressurization of the material to be discharged.

BACKGROUND OF THE INVENTION

Dispensers utilizing chemical propellants have been in widespread use for many years, and have been a very successful packaging system. However, in recent years evidence has been produced which indicates that many of the chemical propellants are or may be harmful to the user and/or to the environment. Thus, legislation has been proposed and passed in many instances, limiting or banning the use of many of the more commonly used chemical propellants, such as fluorocarbons and the like.

Additionally, handling and disposing of such dispensers poses a serious problem because of the danger of explosion created by the propellants. Further, due to the nature of such propellants, the dispensers must be constructed to withstand high internal pressures, and design of the containers for aesthetic reasons is thus limited. Moreover, the number of products which may be dispensed is limited because of incompatibility of the propellants with some of the materials to be dispensed.

Accordingly, in view of the above problems, there has been a great effort in recent years to develop a dispenser which does not require the use of the chemical propellants, but yet which will achieve the same or comparable performance characteristics as the propellant operated dispensers. For example, it is desirable to achieve a sufficiently high pressure to obtain proper atomization of the product being dispensed. Also, it is desirable in some instances to achieve relatively long duration or continuous discharge of material. Further, compatibility of the dispenser components with the material being dispensed is necessary and, in any device of the type with which this invention is concerned, the structure should be simple and economical to manufacture, assemble and operate.

THE PRIOR ART

Many different types of dispensers have been developed in an effort to solve the above problems and to meet the desired objectives, ranging from finger operated reciprocating pumps and trigger operated devices to rotatable actuators operable through cam structures, to discharge the product under pressure.

Examples of some such prior art devices are disclosed in U.S. Pat. Nos. 3,061,202, 3,379,381, 3,471,065, 3,749,290, 3,790,034, 3,865,313, 3,921,861, 3,940,029, 4,022,354, 4,072,252 and 4,079,865. While some of these devices achieve a relatively high pressure discharge, and others achieve a long duration discharge without requiring simultaneous operation of the actuator, and still others achieve substantially continuous discharge during operation of the actuator, none of them solve all of the problems or meet all of the objectives and performance characteristics of the propellant operated devices. For example, some of these prior art devices are very complex and expensive in construction, and/or are difficult to operate. Others are made of materials, or include components made of materials, which are not compatible with many of the products to be dispensed.

SUMMARY OF THE INVENTION

The present invention is a dispenser which is exceptionally simple and economical to manufacture, assemble and use and which is capable of obtaining either an intermittent discharge or a continuous discharge of material. Further, the device of the invention is made of materials which are compatible with most, if not all, of the products to be dispensed.

More particularly, the present invention is a trigger operated dispenser which has a plurality of expansible chambers therein, operable upon manipulation of the trigger to draw material from a container with which the dispenser is associated, pressurize the material and accumulate it under pressure for subsequent discharge. The accumulating chamber of the invention enables a substantially continuous discharge of material to be obtained, in that it stores a quantity of material sufficient to maintain discharge of the material even when the trigger operator is being returned to a position for a subsequent pressurization stroke. The nozzle associated with the trigger operated dispenser of the invention has a plurality of positions, including: an off position, at which no flow can or will occur from the device; a continuous spray position whereat substantially continuous discharge or spray of material is obtained from the device during actuations of the trigger operator; a pulsating spray or discharge position whereat intermittent or pulsating sprays of material are obtained when the trigger is operated; and a pulsating or intermittent stream position whereat a pulsating stream of material is obtained when the trigger is operated.

Moreover, the trigger operated dispenser of the invention is made substantially entirely of plastic materials and is thus compatible with most products likely to be dispensed.

The accumulating chamber of the dispenser of the invention comprises a unique floating piston arrangement, and a valve means is provided to prevent discharge of material until a predetermined pressure is reached.

Additionally, a unique, positive vent is provided in association with the pump chamber, and the vent is normally closed.

Accordingly, the device of the invention is of nonflowthrough construction, and leakage of material from the device will not occur during handling and shipment. Further, squeezing of the container with which the device is associated will not result in material leaking from the dispenser of the invention.

Still other features of the invention include: easy priming with initial squeezes only, which need not be repeated; the absence of any bladder, metal springs or rubber parts; the use of fewer parts than most previously known units; the need for less expensive molding equipment than prior art devices; ease of assembly; the capability of being refilled; the ability to be produced with materials commonly used in the industry; the adaptability to existing container configurations; and a size advantage compared to other units.

OBJECTS OF THE INVENTION

It is an object of this invention to provide a dispenser which does not use chemical propellants and which is simple and economical in construction and which is easy to use.

Another object of this invention is to provide a dispenser which is made entirely of materials which are compatible with the product to be dispensed.

A further object is to provide a mechanically operated dispenser which is capable of operating in more than one mode, as for example, intermittent discharge and continuous discharge.

A still further object is to provide a dispenser which does not use chemical propellants and which obtains a sufficiently high pressure to atomize the material being dispensed and yet which requires very little force to operate it.

A more specific object of the invention is to provide a dispenser which is made substantially completely of plastic materials.

An even further object of the invention is to provide a trigger operated dispenser which is capable of obtaining continuous discharge of product.

Yet another object of the invention is to provide a trigger operated dispenser which is capable of achieving either intermittent discharge or continuous discharge of material and wherein positive vent means is provided.

A further object of the invention is to provide a trigger operated dispenser which has a product accumulating chamber and means associated therewith for obtaining either a continuous or an intermittent discharge of material and wherein means is included for preventing discharge of material until a predetermined pressure has been reached.

BRIEF DESCRIPTION OF THE DRAWINGS

FIG. 4 is an enlarged exploded perspective view of the dispenser of the invention.

FIG. 5 is a rear view, with portions in section, of the dispenser of the invention.

FIG. 6 is a front view, with portions in section, of the dispenser of the invention.

DETAILED DESCRIPTION OF THE PREFERRED EMBODIMENT

Figure 1:
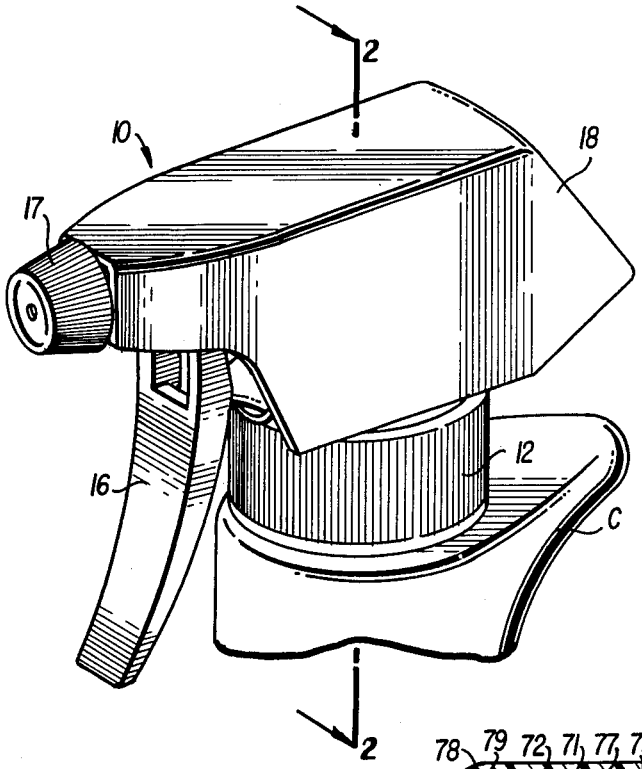
FIG. 1 is a fragmentary perspective view showing the dispenser of the invention on a container.

In the drawings, wherein like reference numerals indicate like parts throughout the several views, a trigger operated dispenser in accordance with the invention is indicated generally at 10, and is shown in FIG. 1 attached to a container C.

As seen best in FIG. 4, the dispenser comprises a body or manifold 11 to which a closure ring 12 is secured by means of an adapter/retainer 13. A combined end cap and valving member 14 is received in the manifold 11, and a floating piston 15 is reciprocable within the chamber defined by the end cap 14 and the manifold 11. A combined piston and trigger unit 16 is carried by the manifold member for drawing material from the container, pressurizing it and transferring it to the chamber defined by manifold 11 and floating piston 15. An adjustable nozzle member 17 is also carried by the manifold 11 and is adjustable to one of four different positions for precluding flow from the device or for obtaining a continuous spray, an intermittent spray, or an intermittent stream. A shroud 18 is adapted to be secured to the manifold in enclosing relationship to the components of the dispenser.

Figure 2:
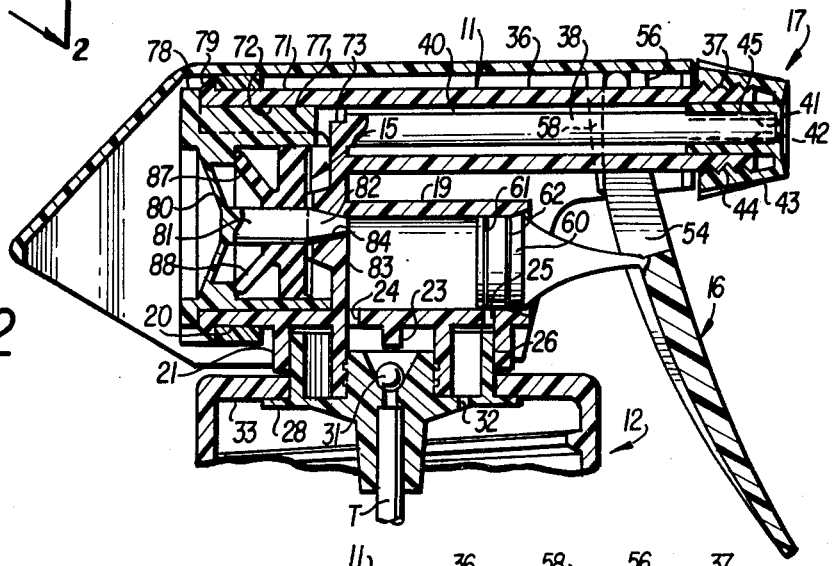
FIG. 2 is an enlarged vertical sectional view taken along line 2—2 in FIG. 1 and showing the trigger in its forward or normal, at-rest position.
Figure 3:
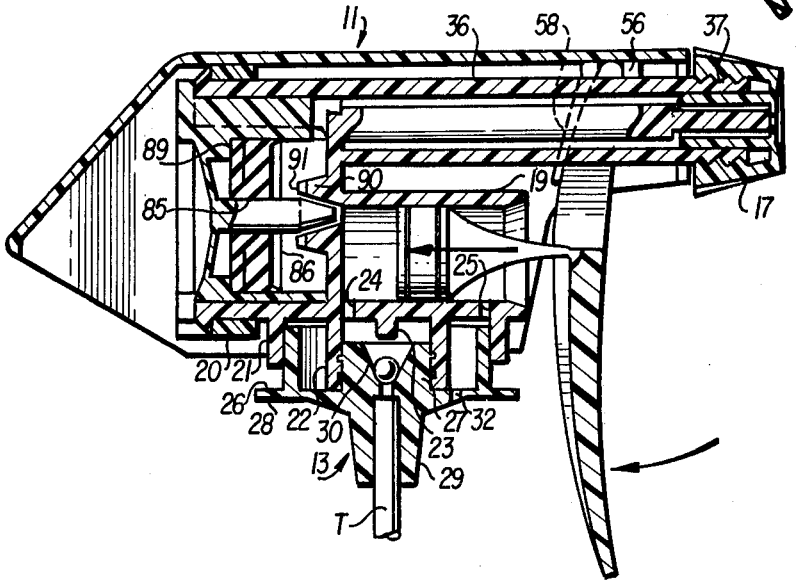
FIG. 3 is a view similar to FIG. 2 showing the trigger depressed or moved rearwardly to pressurize material in the pump chamber.
Figure 7:
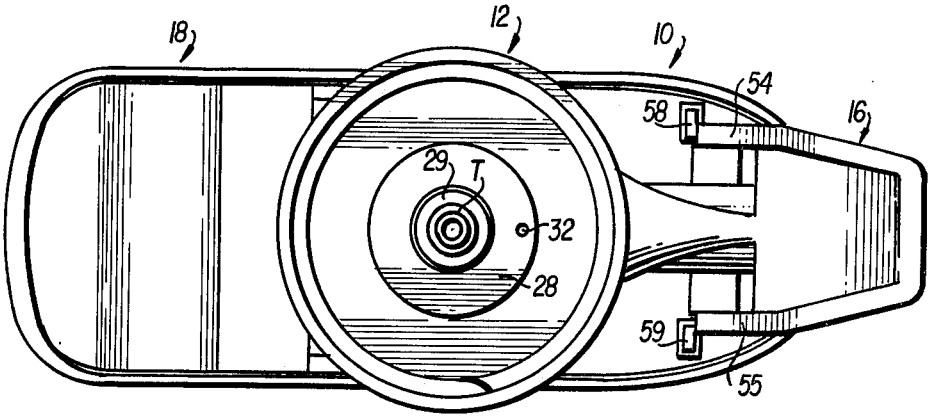
FIG. 7 is a bottom view of the dispenser of the invention.
Figure 8:
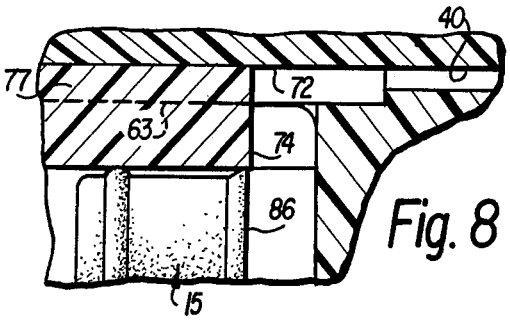
FIG. 8 is a greatly enlarged fragmentary view in section of the outlet port means from the accumulating chamber of the dispenser.
Figure 9:
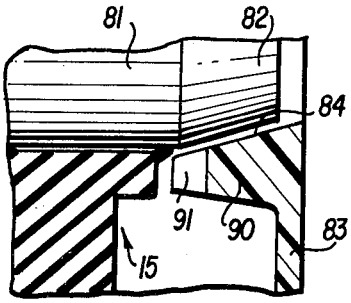
FIG. 9 is a greatly enlarged fragmentary view in section, of the inlet valve pintle and seat structure leading to the accumulating chamber of the invention showing both the valve pintle and the floating piston moved rearwardly.
Figure 10:
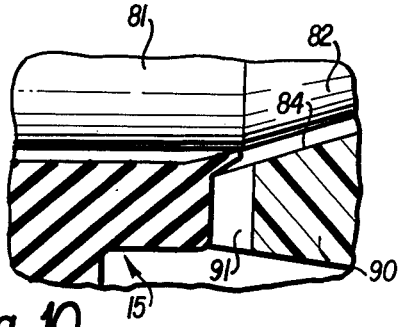
FIG. 10 is a further enlarged view of the structure shown in FIG. 9 with the valve pintle unseated but with the floating piston engaged against the stops.
Figure 11:
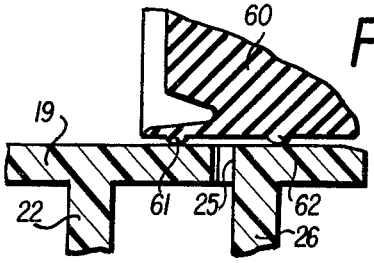
FIG. 11 is an enlarged fragmentary view in section of a portion of the pump piston and showing its relationship to the vent for the container.

As seen best in FIGS. 2, 3 and 4, the manifold 11 includes a first, forwardly extending cylinder 19 defining a pump chamber and a second, rearwardly extending cylinder 20 defining an accumulating chamber. The cylinder 20 is substantially larger in diameter than the cylinder 19 and the bottom edges of the cylinders 19 and 20 are substantially coplanar. A first cylindrical depending skirt 21 is formed on the bottom side of cylinders 19 and 20, and a second depending skirt 22 is formed concentrically with cylinder 21 in radially inwardly spaced relationship thereto. A valve stop 23 is formed centrally of the space bounded by depending skirt or wall 22, and an inlet opening 24 is formed through the bottom of cylinder 19 from the space bounded by skirt or wall 22. A vent opening 25 is also formed through the bottom portion of cylinder 19 in the space between skirts or walls 21 and 22 and communicates with the interior of cylinder 19 adjacent the open forward or outer end thereof.

The adapter/retainer 13 has an upstanding cylindrical wall 26 thereon which fits snugly within the depending cylindrical wall or skirt 21 of the manifold 11, and an upstanding cylindrical boss or projection 27 which fits sealingly with a series of retainer rings within the depending wall or skirt 22 of the manifold 11, to securely hold the adapter/retainer and manifold in assembled relationship. The adapter/retainer also has a radially outwardly projecting flange thereon and a depending boss or projection 29. A dip tube T is fitted within the projection or boss 29, and the interior surface of the upstanding projection 27 is outwardly flared to define a generally conically shaped valve chamber 30 in which a valve ball 31 is received. A vent opening 32 is formed through the flange 28 in the area between upstanding wall 26 and projection 27.

The closure ring 12 has a top wall 33 and a central opening 34 formed therethrough and a depending cylindrical side wall 35. The upstanding wall 26 of adapter/retainer 13 extends through the opening 34 and the flange 28 extends beneath the inner peripheral margin of top wall 33 surrounding opening 34 for rotatably supporting the closure ring 12 to the assembled adapter/retainer and manifold 11.

Thus, with this structure the dispenser of the invention may be readily attached to existing containers having threaded openings. Alternatively, of course, different types of closure or connectors could be used with the dispenser of the invention and the dispenser could be applied with crimped connections or the like to other types of containers.

The manifold 11 also includes an elongate forwardly extending nozzle tube 36 formed integrally with the accumulating chamber cylinder 20 and projecting forwardly therefrom generally parallel to the pump chamber cylinder 19. The nozzle tube has an externally threaded forward end 37, and an elongate shaft or stem 38 projects coaxially through the nozzle tube 36 and extends at its outer or forward end 39 beyond the open forward end of tube 36. The stem 38 and tube 36 define an annular passage 40 therebetween for flow of material from the accumulating chamber to the nozzle 17. In this connection, the forward end of stem 38 has a pair of flow channels 41 and 42 therein for flow of product to the outlet orifice in the nozzle. The nozzle has a generally cylindrical skirt 43 with threads 44 therein adapted for mating cooperation with the threads 37 on nozzle tube 36 whereby the nozzle may be axially adjusted on the nozzle tube to obtain the four different modes or control positions thereof as noted previously. A relatively short, rearwardly extending sleeve or tube 45 on the nozzle extends over the forward end of stem 38 into the annular space 40 sealing the space and limiting flow from the device to the passages 41 and 42 in the stem 38.

A pair of trigger supporting shoulders 46 and 47 are formed on the nozzle tube 36 on opposite sides thereof adjacent the forward threaded end 37 and include a horizontally extending support or land 48 and 49, respectively, and a generally vertically extending stop or abutment 50 and 51, respectively, for cooperation with the inwardly directed pivot pins 52 and 53 on the arms 54 and 55 of trigger 16.

A pair of depending abutments or stops 56 and 57 are formed in the shroud 18 and depend into proximity with the shoulders 46 and 47 for retaining the pivot pins 52 and 53 on the shoulders against the stops 50 and 51. Further, a pair of leaf-spring-like elements 58 and 59 are integrally formed with the shroud 18 and depend from the shroud into operative engagement with the rear surfaces of arms 54 and 55 of the trigger 16 to normally bias the trigger 16 into a forward position as seen in FIG. 2.

A piston 60 is formed integrally with the trigger and has a pair of circumferential, axially spaced apart sealing rings 61 and 62 thereon. In its normal, at-rest position the piston is disposed at the forward end of the pump chamber 19 as seen in FIG. 2 and the sealing rings 61 and 62 are disposed on opposite sides of the vent opening 25, sealing the vent opening from the atmosphere and also sealing the vent opening from the pump chamber defined by the cylinder 19 and piston 60. However, when the trigger is moved rearwardly as seen in FIG. 3, the piston 60 is also moved rearwardly to pressurize the contents of the pump chamber and in this position the vent opening 25 is exposed to atmosphere thereby venting the container via the openings 25 and 32.

The combined end cap and valving member 14 comprises inner and outer concentric cylinders 63 and 64, respectively, with the outer surface of the inner cylinder approximately the same as or slightly less than the inner surface of the accumulating chamber cylinder 20, and the inner surface of outer cylinder 64 being substantially the same as or slightly greater than the outer surface of accumulating chamber cylinder 20, whereby the inner and outer cylinders 63 and 64 define an annular space therebetween in which the accumulating chamber cylinder 20 is received. The wall of outer cylinder 64 has a plurality of openings 65, 66 and 67 formed therethrough at the rearward end thereof and a plurality of detents or snap members 68, 69 and 70 are formed on the rear outer surface of cylinder 20 for snap-fitting engagement in the openings 65, 66 and 67 to hold the end cap and valve member 14 secured to the manifold 11.

An upstanding channel-shaped configuration 71 is formed on the top side of accumulating chamber cylinder 20 and defines an elongate channel-shaped passage 72 communicating with the accumulating chamber and having a forward end portion 73 communicating with the annular chamber 40 extending to the nozzle.

The inner cylindrical wall 63 of the combined end cap and valving member 14 has an opening 74 formed through the top side thereof in a position to be in registry with the channel 72 when the parts are assembled as seen in FIGS. 2 and 3, and an upstanding alignment structure 75 is formed on the top of the outer cylinder 64 for mating cooperation with the channel-shaped member 71 on the manifold 11. The alignment member 75 has a hollow interior 76 complemental in size and shape to the size and shape of channel member 71, and an upstanding, elongate flange or wall member 77 is formed within the alignment member 75 for engagement in the channel 72 of channel member 71 when the parts are assembled together. Additionally, an opening 78 is formed through the alignment member 75 at the rear end portion thereof for cooperation with a snap detent 79 formed on the rear end of channel member 71.

A relatively thin, generally conically-shaped diaphragm-like end wall 80 is integrally formed with the combined end cap and valving member 14 adjacent the rearward end thereof and has an elongate, forwardly projecting valve pintle 81 formed integrally therewith in the center thereof and terminating at its forward end in a generally frustoconically shaped valving member or nose portion 82.

The inner or forward end of accumulating chamber cylinder 20 is closed by a wall 83 which is also common to the rearward closed end of pump chamber cylinder 19, and a valve port 84 is formed through the wall 83 in a position disposed on the axis of cylinder 20. The valve port 84 is flared outwardly toward the accumulating chamber and is complemental in size and shape to the tapered end portion 82 of valve pintle 81 whereby the valve pintle is normally seated in the port 84 closing it off to flow therethrough and is maintained in the closed position by the natural resiliency of diaphragm-like end wall 80.

The floating piston 15 is disposed in the accumulating chamber and has a central bore or opening 85 therethrough in which the valve pintle 81 is slidably received. The piston 15 also has a forwardly projecting annular sealing skirt 86 which is sealably engaged against the inner surface of the forwardly projecting inner cylinder 63 of the combined end cap and valving member 14. A pair of integrally molded leaf-spring members 87 and 88 are formed on the rear of the floating piston 15 and the free ends of the leaf-spring members 87 and 88 are engaged against a forwardly facing shoulder 89 formed in the inner bore of the cylinder 63.

Thus, in the normal at-rest position, the floating piston 15 is biased forwardly as seen in FIG. 2.

The wall 83 has a rearwardly projecting annular boss 90 formed around the valve port 84 and a plurality of stops 91 are formed on the rearward ends of the boss 90 for engagement with the piston 15 to limit the forward movement thereof to a position as seen in FIG. 2.

The shroud 18 has depending side walls 92 and 93 which, as seen best in FIGS. 5 and 6, depend on either side of the manifold 11, and the opposite sides of the combined end cap and valving member 14 are flattened as at 94 and 95 for flat engagement against the inner surfaces of the side walls 92 and 93. Additionally, stops or detents 96 and 97 are formed on the flats 94 and 95 for cooperation with corresponding stops or detents 98 and 99 on the inner surface of the shroud side walls 92 and 93.

Additionally, similar stops or detents 100 and 101 are formed nearer the bottom edges of side walls 92 and 93 for cooperation with similar stops or detents 102 and 103 on the depending cylindrical wall or skirt 21 of manifold 11.

OPERATION

In use, the nozzle 17 would normally be turned to a closed position for shipping and handling, and subsequently, when the user desired to dispense material from the container C, the nozzle would be turned to one of the remaining three positions as noted previously herein for desired discharge of the material. Assuming that a continuous spray of the material is desired, the nozzle would be turned to a position whereat the restriction to flow defined thereby is such that the volume of material capable of being dispensed through the nozzle is less than an amount which would normally be accumulated in the accumulating chamber by independent movement of the pintle and piston rearwardly against the bias of their respective springs 80 and 87,88. In other words, with the parts disposed in their normal at-rest position as seen in FIG. 2, the trigger 16 would be operated rearwardly, compressing the material in the pump chamber 19. Subsequent return of the piston and trigger forwardly under the action of springs 58 and 59 engaged with the trigger produces a low pressure in the pump chamber, drawing material upwardly through the dip tube T past ball valve 31 and through port 24 into the pump chamber. Thereafter, rearward movement of the trigger and piston 60 carried thereby pressurizes the material in the pump chamber, and this pressure acting against the end of pintle 81 exposed to the interior of the pump chamber causes the valve pintle 81 to move rearwardly against the bias of its spring wall 80 enabling the pressurized contents of pump chamber 19 to flow into the accumulating chamber against the piston 15, which then moves rearwardly against the bias of springs 87 and 88 to accumulate an amount of material therein under pressure. Simultaneously, the pressurized material flows through port 74 to the nozzle for discharge, as desired.

With the nozzle set to obtain a continuous discharge of material, the subsequent return of the trigger and piston to their forward position results in the valve pintle 81 closing under the action of its spring 80 and at the same time the piston 15 is urged forwardly by its springs 87 and 88 to force material from the accumulating chamber through the outlet port 74 and through the nozzle, even though the trigger and piston have moved forwardly and are no longer pressurizing the material in the pump chamber.

The bias or strength of springs 80 and 87, 88, and the size or volumes of the chambers, in conjunction with the size of the outlet orifice, are selected such that a predetermined preload pressure is required in order to effect flow of material to the nozzle, and also, the rate of exhaust of fluid from the chamber is such that flow through the nozzle can be continued even during the time the piston 60 is moving forward on an intake stroke. Accordingly, positive opening is provided by the invention, whereby dribble, as might be caused by insufficient pressure, is avoided, and either continuous or intermittent flow can be obtained.

By way of example, a typical device constructed in accordance with the invention would require approximately 100 p.s.i. to open the valve pintle 81, and a spray pressure of from 80 to 100 p.s.i. is obtained from the accumulating chamber.

Of course, selection of various dimensional relationships of the pistons and chambers and locations of the ports and strengths of the biasing springs can be used to effect a wide range of pressure pre-loads and operative spray pressure and the like.

If it is desired to obtain an intermittent discharge of material from the dispenser, the nozzle is turned to a position whereat the restriction of flow therethrough is not great enough to prevent exhaustion of material from the accumulating chamber upon return of the piston and trigger to their initial position for a subsequent pressurization stroke.

Therefore, with the present invention, either an intermittent or continuous spray action can be easily achieved and the duration of the continuous spray can be selected for any desired frequency of operation of the trigger necessary to maintain the continuous discharge of material.

Moreover, because of the unique valving structure embodied in the present invention, only initial priming is necessary and the pump remains primed thereafter. Still further, the unique valving structure of the invention, and particularly in combination with the nozzle, provides a child safety feature.

MODIFICATION

Figure 12:
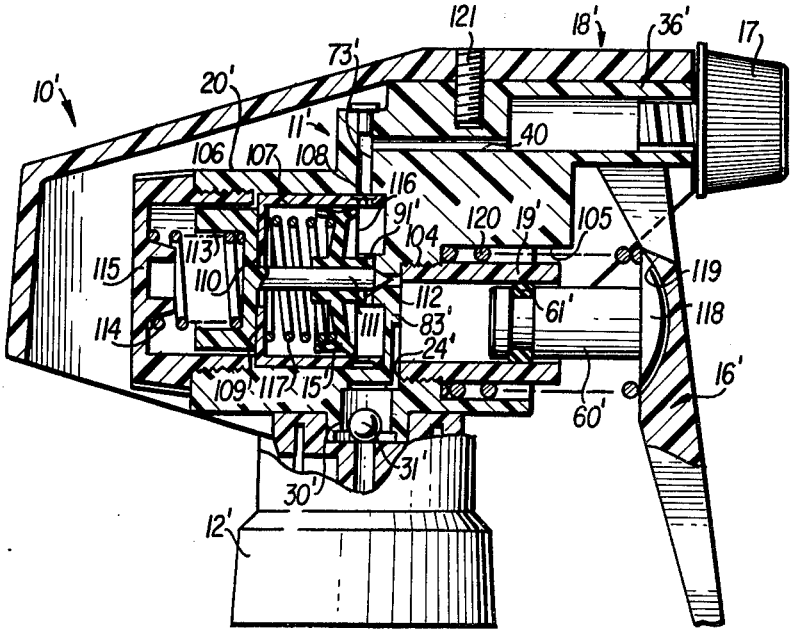
FIG. 12 is a fragmentary vertical section view similar to FIG. 2 of a modification of the invention.

A modified continuous action dispenser is indicated generally at 10' in FIG. 12 and comprises a manifold 11' having a separate, threaded in place, forwardly extending pump cylinder 19' threaded to the manifold at 104 and disposed in radially inwardly spaced relationship to a recess 105 formed in the manifold 11'. An integrally formed, rearwardly extending accumulating chamber cylinder 20' is also formed on the manifold 11' and has an open, internally threaded rearward end 106.

A generally cup-shaped sleeve or insert 107 is disposed in the cylinder 20' and has its open forward end engaged against the end of cylinder 20' and has an outlet port 108 formed through the side wall thereof in registry with an outlet port 73' formed in the manifold 11'. The rear end wall 109 of insert 107 has a central opening 110 therethrough and an elongate valve pintle 111 extends through the opening 110 into engagement with a valve seat 112 formed on wall 83' separating the pump chamber from the accumulating chamber.

The valve pintle 111 is carried by a cup-shaped member 113 disposed in the outer end portion of cylinder 20' and biased in a forward direction by a coil spring 114 engaged with the cup-shaped member at one end and engaged at its other end on the inner surface of an adjustable end cap 115. Thus, by adjustment of the end cap 115 the opening pressure required to move valve pintle 111 from its seat 112 can be adjusted.

A floating piston 15' is disposed within the insert 107 in surrounding relation to the valve pintle 111 and has a sealing skirt 116 for sealing engagement with in the insert 107. The piston 15' is normally biased to its forward position by a coil spring 117 engaged at one end with the piston engaged at its other end against the end wall 109 of insert 107.

An inlet ball valve 31' is disposed in an inlet valve chamber 30' for preventing reverse flow from inlet port 24' through the chamber and into a dip tube, not shown.

A piston 60' having a sealing ring 61' thereon is reciprocably disposed in the pump chamber 19' and has an elongate rod with an arcuate, convexly formed forward end 118 nestably received in a correspondingly shaped socket 119 formed in trigger 16'. The piston and trigger are normally biased to the forward position shown in FIG. 12 by a coil spring 120 engaged at one end against the rear surface of forward end portion 118 of the piston rod and engaged at the other end in the bottom annular space defined between pump chamber cylinder 19' and recess 105 in the manifold 11'.

A nozzle tube 36' is formed integrally with the manifold 11' and extends forwardly therefrom in generally parallel relation to the pump chamber 19'.

A nozzle 17' is suitably secured to the nozzle tube 36' for controlling flow from the nozzle tube, and the nozzle may be of any conventional configuration.

The shroud 18' is secured to the manifold 11' by means of a screw or the like 121 extended through the top of the shroud and into the top of the manifold 11'.

Thus, with this form of the invention, the integrally molded springs are eliminated and conventional coil springs are used to bias the pistons to their respective at-rest positions. Additionally, the end cap 115 may be adjusted to adjust the opening pressure required for valve pintle 111 if desired, although this member could be fixed if desired.

In all other respects, this form of the invention operates generally the same as that previously described. In this connection, although no positive acting vent means has been shown in association with the pump chamber 19', it should be understood that a vent control such as utilized in the first form of the invention could be provided in this form of the invention as well, or other types of vent could be provided.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. A dispenser, comprising: a body having a plurality of expansible chambers therein, including a pump chamber and an accumulating chamber; a manually operated actuator accessible exteriorly of the dispenser and having means connected with the pump chamber to alternately enlarge and reduce the volume of the pump chamber when the actuator is operated; said accumulating chamber having a resiliently yieldable means whereby the accumulating chamber volume is enlarged when material is moved thereinto by the pump chamber, to thereby accumulate under pressure a quantity of the material; and adjustable means connected with the accumulating chamber to adjust the rate of discharge of material from the accumulating chamber, the quantity of accumulated material and the selected rate of discharge enabling either an intermittent or a continuous discharge to be obtained during multiple operations of the actuator.

2. A dispenser as in claim 1, wherein the adjustable means comprises a discharge nozzle having means for varying the restriction to flow therethrough.

3. A dispenser as in claim 1, wherein the manually operated actuator comprises a pivoted trigger.

4. A dispenser as in claim 1, wherein the accumulating chamber comprises a cylinder and a piston reciprocable in the cylinder, said piston having spring means molded integrally therewith for biasing the piston in a direction to reduce the size of the chamber defined by the piston and cylinder.

5. A dispenser as in claim 1, wherein the accumulating chamber comprises a cylinder and the resiliently yieldable means comprises a movable member in the cylinder; an inlet opening from the pump chamber to the accumulating chamber; and the movable means further including a valve pintle reciprocable toward and away from the inlet opening and normally extending into closing relationship relative to the inlet opening, said valve pintle being biased into said closing relationship, and being openable against said bias by pressure of material in the pump chamber, said valve pintle requiring a predetermined positive pressure to open it and thus insuring that a predetermined positive pressure exists in the accumulating chamber before discharge of the material can occur.

6. A dispenser as in claim 5, wherein spring means is engaged with the pintle, biasing it toward its closed position; and adjustable means is engaged with the spring means for adjusting the bias thereof to thereby adjust the opening pressure of said pintle.

7. A dispenser as in claim 1, including an inlet valve to the pump chamber, said inlet valve comprising a steel ball, and all of the remaining components of the dispenser comprising synthetic plastic materials.

8. A dispenser as in claim 1, wherein the accumulating chamber comprises a cylinder and a piston reciprocable in the cylinder, said piston having an axial opening therethrough; an inlet opening from the pump chamber to the accumulating chamber, said opening in the piston being aligned with the inlet opening; and a valve pintle reciprocably and sealably received through the opening in the piston and normally extending into closing relationship relative to the inlet opening, said valve pintle being biased into said closing relationship, and being openable against said bias by pressure of material in the pump chamber, said valve pintle requiring a predetermined positive pressure to open it and thus insuring that a predetermined positive pressure exists in the accumulating chamber before discharge of the material can occur.

9. A dispenser as in claim 8, wherein a dividing wall separates said pump chamber from said accumulating chamber, said inlet opening being formed through said dividing wall, and rearwardly projecting stop means formed on said dividing wall around said inlet opening in a position to be engaged by the piston in the accumulating chamber to stop a forward movement of the piston.

10. A dispenser as in claim 9, wherein the piston has seal means on the outer periphery thereof sealingly engaged with the inner surface of the accumulating chamber, and seal means around the opening therethrough sealingly engaging the valve pintle to prevent leakage of material between the piston and valve pintle.

11. A dispenser as in claim 1, wherein the body comprises a one-piece molded plastic manifold member having a forwardly extending cylinder defining said pump chamber and a rearwardly extending cylinder defining the accumulating chamber, said cylinders being separated by a dividing wall having an inlet opening therethrough from the pump chamber to the acumulating chamber; depending wall means integrally formed on the underside of said cylinders; connecting means carried by said depending wall means for securing said dispenser to a container; a forwardly extending nozzle tube integrally joined at one end with the accumulating chamber cylinder and projecting generally parallel to the pump chamber cylinder; a reciprocable plastic piston in said accumulating chamber cylinder movable rearwardly to enlarge the accumulating chamber volume when fluid under pressure enters the accumulating chamber from the pump chamber; and normally closed plastic valve means in the accumulating chamber movable toward and away from the inlet opening to prevent flow therethrough into the accumulating chamber until a predetermined positive pressure is reached.

12. A dispenser as in claim 11, wherein the accumulating chamber cylinder has an open rearward end and an end cap is received in said open end closing the open end; said normally closed plastic valve means comprising an integral part of said end cap and said end cap having a flexible, resiliently yieldable wall to which said valve means is integrally joined; said reciprocable piston in said accumulating chamber comprising an accumulator piston having integral spring means molded therewith, said spring means engaged against said end cap to normally urge the piston forwardly toward said dividing wall; and raised stop means on said dividing wall around said inlet opening projecting into said accumulating chamber for engagement with said piston to limit the forward movement of said piston; said normally closed valve means comprising an elongate valve pintle extended through and sealed with a central opening in said piston and having a valve member on its forward end for cooperation with the inlet opening to close the inlet opening when the pintle is urged forwardly by the resilient end wall of the end cap.

13. A dispenser as in claim 1, wherein the actuator comprises a pivoted trigger, and a piston is integrally molded with the trigger and is reciprocable in the pump chamber when the trigger is operated to alternately enlarge and then reduce the volume of the pump chamber; and vent means associated with the pump chamber, including an opening in the side of the pump chamber communicating the pump chamber with a container on which the dispenser is secured, said pump chamber having an open forward end communicating with atmosphere, and said piston having axially spaced sealing means thereon disposed on opposite sides of the vent opening to close the vent opening when the pump piston is in a forward, at-rest position, said sealing means uncovering said vent opening and exposing it to atmosphere when the pump piston is moved rearwardly to pressurize the contents of the pump chamber.

14. A dispenser as in claim 1, wherein the body comprises a molded plastic member having a forwardly projecting pump chamber cylinder and a rearwardly projecting accumulating chamber cylinder, said cylinders being separated by a dividing wall having an inlet opening from the pump chamber to the accumulating chamber; said resiliently yieldable means in the accumulating chamber comprising an accumulator piston reciprocable toward and away from said dividing wall; spring means engaged with said piston urging it toward said dividing wall; an inlet valve means in said accumulating chamber for movement toward and away from said inlet opening and normally biased into closing relationship relative to said inlet opening to prevent flow into said accumulating chamber until a predetermined positive pressure has been reached; spring means engaged with said inlet valve means normally urging the inlet valve means into its closed position; and adjustable end cap means secured to said accumulating chamber cylinder, said spring means for said inlet valve means being engaged with said adjustable end cap means whereby said end cap means may be adjusted to vary the bias on said spring means and thereby vary the opening pressure required for said inlet vlave means.

15. A dispenser as in claim 14, wherein a piston is reciprocably disposed in said pump chamber cylinder for alternately enlarging and reducing the volume of said pump chamber, said piston having a forwardly projecting piston rod with a convexly-shaped end on the rod; the actuator comprising a pivoted trigger connected with said body and having a socket in the rear surface thereof complementary to the convexly-formed forward end of said piston rod and in which said convexly-formed piston rod end is received, whereby actuation of said trigger causes reciprocation of said piston; spring means engaged between said body and said piston rod end, normally urging the piston and trigger forwardly to enlarge the volume of the pump chamber; and a shroud removably secured to said body in enclosing relationship to said cylinders.

16. A dispenser as in claim 1, wherein the adjustable means comprises an adjustable nozzle having a plurality of positions for obtaining different restrictions to flow therethrough whereby discharge therefrom may be either a continuous spray during operation of the actuator, intermittent spray corresponding to operation of the actuator to decrease the volume of the pump chamber, intermittent streams corresponding to operation of the actuator to decrease the volume of the pump chamber and an off position whereat no flow can occur through the nozzle; said actuator comprising an integrally molded one-piece piston and trigger, said trigger being pivotally connected to said body and said piston being reciprocably mounted in said pump chamber; said resiliently yieldable means in said accumulating chamber comprising a reciprocable piston having an integrally molded spring means thereon normally biasing the piston in a direction to decrease the volume of said accumulating chamber; said accumulating chamber and pump chamber being separated by a dividing wall having an inlet opening to the accumulating chamber; and an inlet valve in said accumulating chamber and normally biased into closing relationship relative to said inlet opening whereby a predetermined positive pressure is required to open the inlet valve and obtain discharge from the dispenser, said inlet valve comprising an elongate valve pintle reciprocably extended through an opening in the piston in the accumulating chamber and integrally formed with a flexible, yieldable end wall on the accumulating chamber; and a shroud secured to said body and disposed in enclosing relationship to said body, said shroud having spring means integrally molded therewith and disposed in a position to engage said trigger to normally urge said trigger in a forward direction to move said piston in a direction to enlarge the pump chamber.

17. A dispenser as in claim 1, wherein the adjustable means comprises a discharge nozzle having means for varying the restriction to flow therethrough; and the manually operated actuator comprises a pivoted trigger.

* * * * *